US009156243B2

(12) United States Patent
Weber

(10) Patent No.: US 9,156,243 B2
(45) Date of Patent: Oct. 13, 2015

(54) SYSTEM INCLUDING A PRINTING PRESS AND A FOIL TRANSFER DEVICE

(71) Applicant: HEIDELBERGER DRUCKMASCHINEN AG, Heidelberg (DE)

(72) Inventor: Alexander Weber, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/319,330

(22) Filed: Jun. 30, 2014

(65) Prior Publication Data

US 2015/0007738 A1 Jan. 8, 2015

(30) Foreign Application Priority Data

Jul. 4, 2013 (DE) ..... 10 2013 011 178

(51) Int. Cl.
*B41F 1/28* (2006.01)
*B41F 16/00* (2006.01)

(52) U.S. Cl.
CPC ..... *B41F 16/0006* (2013.01)

(58) Field of Classification Search
CPC ..... B41F 16/006
USPC ..... 101/407.1
See application file for complete search history.

(56) References Cited

U.S. PATENT DOCUMENTS

| | | | | | |
|---|---|---|---|---|---|
| 3,445,984 | A * | 5/1969 | Kelly | 53/505 |
| 3,606,438 | A * | 9/1971 | Feczko | 294/68.27 |
| 3,827,746 | A * | 8/1974 | Byers | 294/82.2 |
| 4,673,142 | A * | 6/1987 | Keene et al. | 242/555.3 |
| 5,085,377 | A | 2/1992 | Rohrer et al. | |
| 5,480,201 | A * | 1/1996 | Mercer | 294/67.31 |
| 5,562,394 | A * | 10/1996 | Brown, Jr. | 414/626 |
| 5,902,448 | A * | 5/1999 | Stettner | 156/510 |
| 6,039,284 | A | 3/2000 | Lehrieder et al. | |
| 2002/0009360 | A1 * | 1/2002 | Thies et al. | 414/785 |
| 2002/0070309 | A1 * | 6/2002 | Stauber et al. | 242/559.3 |
| 2010/0289284 | A1 * | 11/2010 | Toon | 294/82.19 |
| 2012/0118184 | A1 | 5/2012 | Sonnenschein et al. | |

FOREIGN PATENT DOCUMENTS

| | | | |
|---|---|---|---|
| DE | 3910444 | A1 | 10/1990 |
| DE | 102005043940 | B4 | 10/2011 |
| DE | 102010051238 | A1 | 5/2012 |
| EP | 1044912 | A1 | 10/2000 |
| EP | 1974917 | B1 | 5/2012 |
| EP | 2468507 | A2 | 6/2012 |
| WO | 2009074571 | A1 | 6/2009 |

OTHER PUBLICATIONS

Helmut Kipphan: "Handbuch der Printmedien: Technologien and Produktionsverfahren" Springer Verlag 2000 pp. 273, 274 [Handbook of Print Media: Technologies and Production Methods].

* cited by examiner

*Primary Examiner* — Anthony Nguyen

(74) *Attorney, Agent, or Firm* — Laurence A. Greenberg; Werner H. Stemer; Ralph E. Locher

(57) ABSTRACT

A system includes a printing press, a transfer device for transferring foil to a printing material in the printing press, and a storage section for temporarily storing winding cores and foil reels. The temporary storage section is formed by a rail system that extends through and beyond the transfer device.

10 Claims, 4 Drawing Sheets

SYSTEM INCLUDING A PRINTING PRESS AND A FOIL TRANSFER DEVICE

CROSS-REFERENCE TO RELATED APPLICATION

This application claims the priority, under 35 U.S.C. §119, of German patent application DE 10 2013 011 178.1, filed Jul. 4, 2013; the prior application is herewith incorporated by reference in its entirety.

BACKGROUND OF THE INVENTION

Field of the Invention

The present invention relates to a system comprising a printing press, a transfer device for transferring foil to printing material, and a storage section for the temporary storage of winding cores and foil reels.

A winding core consists of a winding shaft and a winding sleeve, which sits on the winding shaft during operation. The winding sleeve from which the foil is unwound or onto which the foil is wound may be made of cardboard or plastic, for instance. During operation, a torque is transmitted from the winding shaft to the winding sleeve or from the winding sleeve to the winding shaft. In the former case, the winding shaft is a shaft in the true sense of the word, for instance a friction shaft. In the other case, the winding shaft is merely an entrained axle but it is nevertheless referred to as a winding shaft. The winding shaft consists of metal, e.g. steel or aluminum. The foil wound onto the winding core or winding sleeve is referred to as a foil coil. A winding core with a foil coil wound thereon is referred to as a foil reel. The foil reels may be supply reels that carry unused foil (also referred to as fresh foil) and collecting reels that carry used foil (also referred to as waste foil), i.e. foil from which foil layers have been removed in some areas during the foil transfer. During operation, the empty winding cores and the full foil reels need to be replaced, for instance when the fresh foil on a supply reel has been used up or when a collecting reel cannot receive more waste foil.

German patent DE10 2005 043 940 B4 describes a system wherein the storage section is formed by a conveying path used for the temporary storage of full foil reels and empty winding cores.

European published patent application EP 2 468 507 A2 and European patent EP 1 974 917 B1, which are commonly assigned to the applicant herein, respectively describe a system wherein a system of rails extends only within a transfer device.

SUMMARY OF THE INVENTION

It is accordingly an object of the invention to provide a further system including a printing press, a foil transfer device, and a storage section which is improved over the heretofore-known devices and methods of this general type.

With the foregoing and other objects in view there is provided, in accordance with the invention, a printing system, comprising:

a printing press;

a transfer device configured for transferring foil to printing material in the printing press; and a storage section for temporarily storing winding cores and foil reels with foil to be transferred to the printing material, the storage section being formed with a rail system extending through and beyond said transfer device.

In other words, in accordance with the invention, the system comprises a printing press, a transfer device for transferring foil to a printing material, and a storage section for the temporary storage of winding cores and foil reels. The novel storage section is formed by a system of rails that extends through and beyond the transfer device.

An advantage of the invention is that the winding cores and foil reels may be stored immediately upstream and downstream of the transfer device, resulting in short transport distances. Moreover, the loading and unloading of the rail system is possible during an ongoing printing operation, reducing the times of standstill of the machine.

The terms "upstream" and "downstream" are used herein with reference to a process flow direction. If, for example, a printing material is transported through the printing system from right to left, then upstream would mean on the right and downstream would mean on the left of the processing machine. In a sheet-fed printing press, for example, the sheet feeder would be on the right, or upstream. The sheet delivery would be on the left, or downstream.

The rail system may comprise two mutually parallel guide rails, each of which extends continuously—i.e. without a rail joint—through and beyond the transfer device. However, each guide rail may be interrupted by one or more rail joints. In this case, the rail joints are located between rail sections that jointly form the guide rail when they are in a mutually aligned arrangement. The rail joints may form open joining gaps, which on the one hand are at least narrow enough for the winding cores or foil reels to roll or slide over the rail joints. If this requirement is met, however, the rail joints may on the other hand be wide enough for a thin shutter or a similar thin closing element of a housing of the transfer device in the closed condition to pass through the rail joint of one of the guide rails or through rail joints of both guide rails. During operation of the transfer device, the housing may be closed by the shutter or closing element because during operation, it is not absolutely necessary to push or pull a winding core or a foil reel into or out of the housing on the rail system. If the shutter or closing element is thicker than the rail joint and does consequently not fit through the rail joint, the guide rail or each guide rail may include a movable or removable rail section that is arranged in the actuating path of the shutter or closing element. For instance, the movable rail section may be a folding rail section that is swung open to widen the rail joint into a gap for the shutter to be moved through as the housing is closed.

The rail system may extend longitudinally and in parallel with the conveying direction of the printing material. If the printing press is a sheet-fed printing press, the conveying direction of the printing material may be the sheet-conveying direction extending from a sheet feeder to a sheet delivery of the printing press. The rail system may consist of multiple guide rails. The guide rails may be linear rails and may be aligned precisely in a horizontal direction, or they may have a slight bevel to cause the winding cores or foil reels to be transported by gravity. The rail system may be arranged above printing units of the printing press and may be supported by the printing press (in the context of the present description, printing units are understood to include varnishing units).

Other features which are considered as characteristic for the invention are set forth in the appended claims.

In accordance with a further development, upstream of the transfer device, the rail system extends beyond the transfer device. If the transfer device is arranged on a printing unit of the printing press, the rail system may extend at least as far as a neighboring printing unit that is arranged upstream of the former printing unit as viewed in the conveying direction of the printing material. The transfer device may be arranged on two printing units—a first printing unit and a second printing unit, which may be adjacent to each other. In this case, one of the two printing units has a mount for a supply reel and the other one of the two printing units has a mount for a collecting reel of the transfer device. In this case, the rail system may extend at least as far as a neighboring printing unit, different from the second printing unit, which is arranged upstream of the first printing unit as viewed in a conveying direction of the printing material.

In accordance with another development, the rail system extends from the transfer device to the sheet feeder of the printing press. In this case, the rail system may extend over multiple printing units arranged either upstream of the printing unit on which the transfer device is provided or, in the aforementioned case in which the transfer device is arranged on two printing units, upstream of the first printing unit as viewed in the conveying direction of the printing material. An advantage of this arrangement is that the space available above the sheet feeder may be used for the temporary storage of winding cores and/or foil reels. This space is easily accessible frequently from multiple sides, simplifying the handling of the cores and reels.

In accordance with again a further development, the rail system extends beyond the transfer device downstream of the transfer device. In this case, the rail system may extend at least as far as a neighboring printing unit that is arranged downstream of the printing unit on which the transfer device is arranged as viewed in the conveying direction of the printing material. If the transfer device is arranged on two printing units, the rail system may extend at least as far as a neighboring printing unit that is different from the first printing unit and arranged downstream of the second printing unit as viewed in the conveying direction of the printing material.

In accordance with again another development, downstream of the transfer device, the rail system extends as far as a sheet delivery of the printing press. In this case, the rail system may extend over multiple printing units, which are arranged either downstream of the printing unit on which the transfer device is provided or—if the transfer device is arranged on two printing units—downstream of the second printing unit as viewed in the conveying direction of the printing material. An advantage of this arrangement is that the space available above the sheet delivery may be used for the temporary storage of the winding cores and/or foil reels. This space is easily accessible, frequently from many sides, simplifying the handling of the cores and/or reels.

In accordance with yet a further development, the rail system has placement areas for the winding cores and the foil reels. The placement areas may be formed by flat depressions in the running surfaces of the guide rails. The winding shafts of the temporarily stored winding cores and foil reels or wheels located on the said winding shafts snap into the depressions to secure the temporarily stored winding cores or foil reels against unintentionally rolling away along the rail system. The placement areas may also be formed by locking devices that secure the winding cores and foil reels in their temporary storage positions. The placement areas may be located directly above the sheet feeder and/or the sheet delivery.

In accordance with yet another development, the rail system includes at least one adjustable rail section. The adjustable rail section may be an intermediate section between two adjacent rail sections. The intermediate section may selectively be adjustable into a first position and into a second position. In the first position, the two adjacent rail sections are connected to each other via the intermediate section, and, together with the intermediate section, form a continuous guide rail. In the second position, the two adjacent rail sections are not connected by the intermediate section and the rail is interrupted by a gap between the two adjacent rail sections. The adjustment of the adjustable rail section may be made by hand or by a motor.

In accordance with an added feature of the invention, the adjustable rail section is located between printing units of the printing press. In the aforementioned first position of the adjustable rail section, the latter blocks or hampers an operator's access to a passage between the two printing units. In the second position of the adjustable rail section, the passage is readily accessible. The passage has a tread on which an operator may stand to carry out maintenance, set-up or monitoring jobs on the printing units such as cleaning an ink fountain in one of the printing units.

In accordance with an additional feature of the invention, the system comprises a lifting device for lifting the winding cores and the foil reels. The lifting device may place the winding cores and foil reels onto the rail system and may lift them off the rail system to load and unload the rail system. The lifting device may be a crane.

In accordance with a further feature of the invention, the lifting device has a receiving element for receiving the winding core or the foil reel and the receiving element includes two fork arms, each of which is longer than the outer diameter of a foil reel that has been filled to the maximum, i.e. it has had the maximum possible amount of foil wound thereon. The foil coil is located between the fork arms when the lifting device lifts or lowers a foil reel. The receiving element may be a bracket in the shape of an inverted U. The fork arms extend beyond the outer diameter of the foil reel held therein and thus protect the foil reel against damage.

In accordance with yet a further development, the lifting device includes centering devices for centering the winding cores and the foil reels relative to the rail system. The centering devices ensure that when a foil reel held by the lifting device is lowered, the winding shaft or the wheels located thereon is/are placed on two mutually parallel guide rails of the rail system. Thus the centering devices ensure that in the above-described lowering process, the foil coil of the foil reel is placed in the center between the two guide rails without colliding with any one of the two guide rails, thus avoiding damage to the foil coil.

In accordance with yet another development, the centering devices are formed by centering bevels that hit the rail system when the winding cores and foil reels are lowered. The centering bevels may be arranged on the inside and/or on the outside of the fork arms relative to the bracket. Only one centering bevel may be provided on each one of the two fork arms. If the centering bevels are arranged on the inside in accordance with a first variant, they face each other and the foil coil that is being held. If the centering bevels are arranged on the outside in accordance with a second variant, they face away from each other and away from the foil coil that is being held. Alternatively, there may be two centering bevels on each of the two fork arms. In this case, the two centering bevels face each other and form a small fork. Each of these two small forks has the shape of an inverted V and forms the lower ends of the two fork arms of the large fork formed by the bracket.

In accordance with a concomitant feature of the invention, the lifting device includes crane hooks with locking elements or closing elements for closing the crane hooks, in particular the empty crane hooks. The closing elements may be spring-loaded in such a way that they are adjustable into the locking position by the spring load and out of the locking position against the spring load. The closing elements may be designed and arranged in such a way that when a winding core is held in the crane hooks, the winding core blocks the closing elements to prevent them from being switched into their locking position. The removal of the winding core from the lifting device or crane hooks is achieved by placing the winding core onto the rail system or the guide rails thereof while continuing the downward movement (lowering) of the lifting device or crane hooks. As the winding core is removed from the crane hooks in this way, the closing elements will automatically snap into their locking position as soon as the winding core is no longer in the crane hooks. This prevents the empty crane hooks from regripping the winding core and lifting it off the rail system as they move upward again. Each closing element includes a wedge surface or stop surface arranged at an angle relative to the horizontal and to the vertical. Upon an upward movement, the stop surface hits the winding core, deriving a horizontal force component from the vertical lifting force of the lifting device. The horizontal force component urges the respective crane hook to the side and causes it to be lifted past the winding core without gripping the latter. The closing elements are preferably ratchet pawls.

Although the invention is illustrated and described herein as embodied in a system including a printing press and a foil transfer device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages in constructional and functional terms will be best understood from the following description of specific embodiments when read in connection with the accompanying drawings.

DETAILED DESCRIPTION OF THE INVENTION

Figure 1:
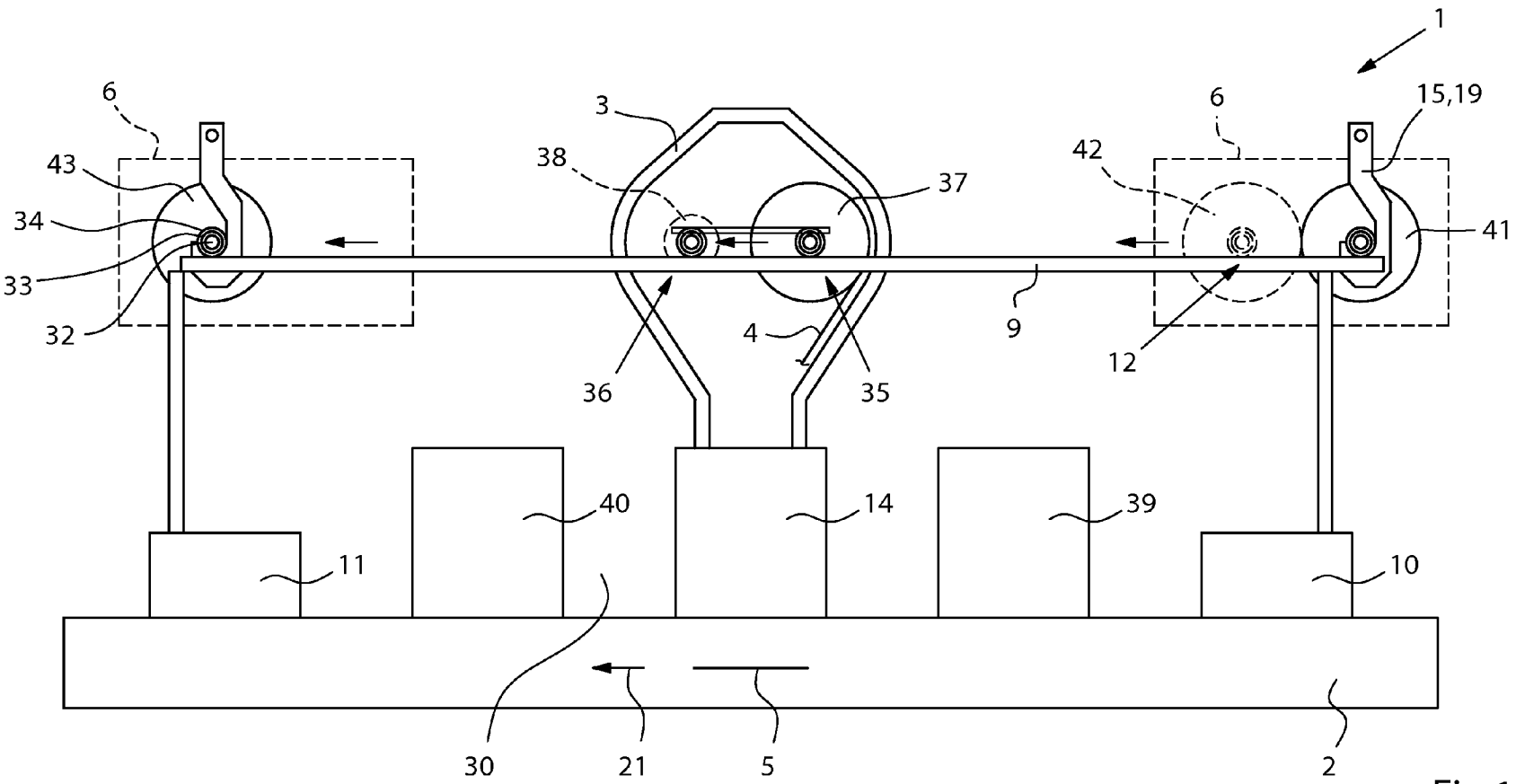
FIG. 1 is an elevation view illustrating a system comprising a sheet-fed offset printing press with a cold-foil transfer device and further comprising a foil reel storage section with a guide rail system.

Referring now to the figures of the drawing in detail and first, particularly, to FIG. 1 thereof, there is shown a system 1 that comprises a printing press 2 and a lifting device 15. The printing press 1 includes a transfer device 3 for a cold-foil transfer onto a sheet-shaped printing material 5, which is conveyed through the press 2 in a printing material conveying direction 21. The printing material 5 is conveyed through a printing unit 14 on which the transfer device 3 is arranged. The transfer device 3 comprises a motor-driven unwinding device that has a first winding shaft lock or a first winding shaft mount 35 for a supply reel 37 for unwinding a foil 4 as well as a motor-driven rewinding device and including a second winding shaft lock or winding shaft mount 36 for a collecting reel 38 for rewinding the foil 4. The actual transfer of pieces of foil (transfer layer) of the multi-layer foil 4 onto the printing material 5 in a cold-foil printing or stamping process occurs in a transfer nip formed by two cylinders of the printing unit 14, which is a lithographic printing unit that has been temporarily converted or permanently modified to transfer foil.

The press 2 further comprises a sheet feeder 10, a sheet delivery 11, a printing unit 39 arranged between the sheet feeder 10 and the transfer device 3, and a printing unit 40 arranged between the transfer device 3 and the sheet delivery 11. As viewed in the printing material conveying direction 21, printing unit 39 is provided immediately upstream of the printing unit 14 that includes the transfer device 3 and printing unit 40 is provided immediately downstream of the printing unit 14 that includes the transfer device 3. In the upstream printing unit 39, an adhesive for gluing the transfer layer or foil pieces to be transferred to the printing material 5 in printing unit 14 is applied to the printing material 5. The upstream printing unit 39 is an offset printing unit that is used for applying an adhesive. The downstream printing unit 40, which is likewise a lithographic offset printing unit, applies ink to the printing material 5 or to the transfer layer glued thereto. To achieve a gold effect on the printing material 5, the transfer layer of the foil 4 that releases the foil pieces may be made of aluminum and yellow offset printing ink may be printed onto the transferred foil pieces.

A rail system 9 comprises two mutually parallel horizontal guide rails 22. In FIG. 1, the front rail conceals the rear rail. The rail system 9 is arranged above the printing units 14, 39, 40, the sheet feeder 10, and the sheet delivery 11. The rail system 9 extends through the unwinding device and the rewinding device of the transfer device 3. Imaginary axes of rotation or central axes of the winding shaft mounts 35, 36 extend perpendicular to the plane of FIG. 1 and are located above the rail system 9, which is located below the winding shaft mounts 35, 36. The rail system passes from the sheet feeder 10 to the sheet delivery 11 via multiple printing units 14, 39, 40. The guide rails 22 protrude beyond the transfer device 3 in the direction of the sheet feeder 10 on the one side and in the direction of the sheet delivery 11 on the other side. In its sections located outside the transfer device 3, the rail system 9 is provided with placement areas 12 for foil reels 41, 42, 43, namely a spare supply reel 41, a replacement reel 42, and a waste reel 43. These sections that include the placement areas 12 form a storage section 6 for the temporary storage of the foil reels 41, 42, 43.

As viewed in the longitudinal direction of the press 2, the storage section 6 is located in the region of the sheet feeder 10, the upstream printing unit 39, the downstream printing unit 40, and the sheet delivery 11 and may even be located in the region of further printing units if one or more further printing units are provided between the sheet feeder 10 and the upstream printing unit 39 and/or between the downstream printing unit 40 and the sheet delivery 11.

Foil reels 41, 42, 43 as well as the foil reels 37, 38 that are in their operating positions in the transfer device 3, namely the supply reel 37 and the collecting reel 38, have a respective winding core 7 consisting of a winding shaft 32 and a winding sleeve 33. One winding shaft 32 is inserted into the first winding shaft mount 35 and coupled to the unwinding device to unwind the foil 5. Another winding shaft 32 is inserted into the second winding shaft mount 36 and coupled to the rewinding device to rewind the foil 5. Depending on the operating situation, more or less or even no foil 4 may be wound onto the winding sleeve 33 located on the winding shaft 32. Each winding shaft 32 has two end sections that protrude from the winding sleeve 33. On each of these end sections, a wheel 34 is provided. On the wheels 34, the winding shaft 32 rolls on the rail system 9. At least one of the two wheels 34 may be connected to the winding shaft 32 in an easily releasable way by a clamp or any other quick-acting lock in order for the winding shaft 32 to be insertable into a respective winding sleeve 33 that has fresh foil 4 wound thereon and to be removable out of a respective winding shaft 33 that has used foil 4 wound thereon. An operator may remove the easily releasable wheel 34 from the winding shaft 32 with or without a tool to prevent the wheel 34 from blocking the insertion or removal of the winding sleeve 33, whose inner diameter is smaller than the outer diameter of the wheel 34. In accordance with an alternative that is not shown in the drawings, the inner diameter of the winding sleeve 33 is greater than the outer diameter of the wheel 34. In this case, the wheel 34 does not have to be connected to the winding shaft 32 in an easily releasable way and the clamp or quick-acting lock may be dispensed with. The winding sleeve 33 may be pushed over the wheel 34 that is connected to the winding shaft 32.

Figure 2:
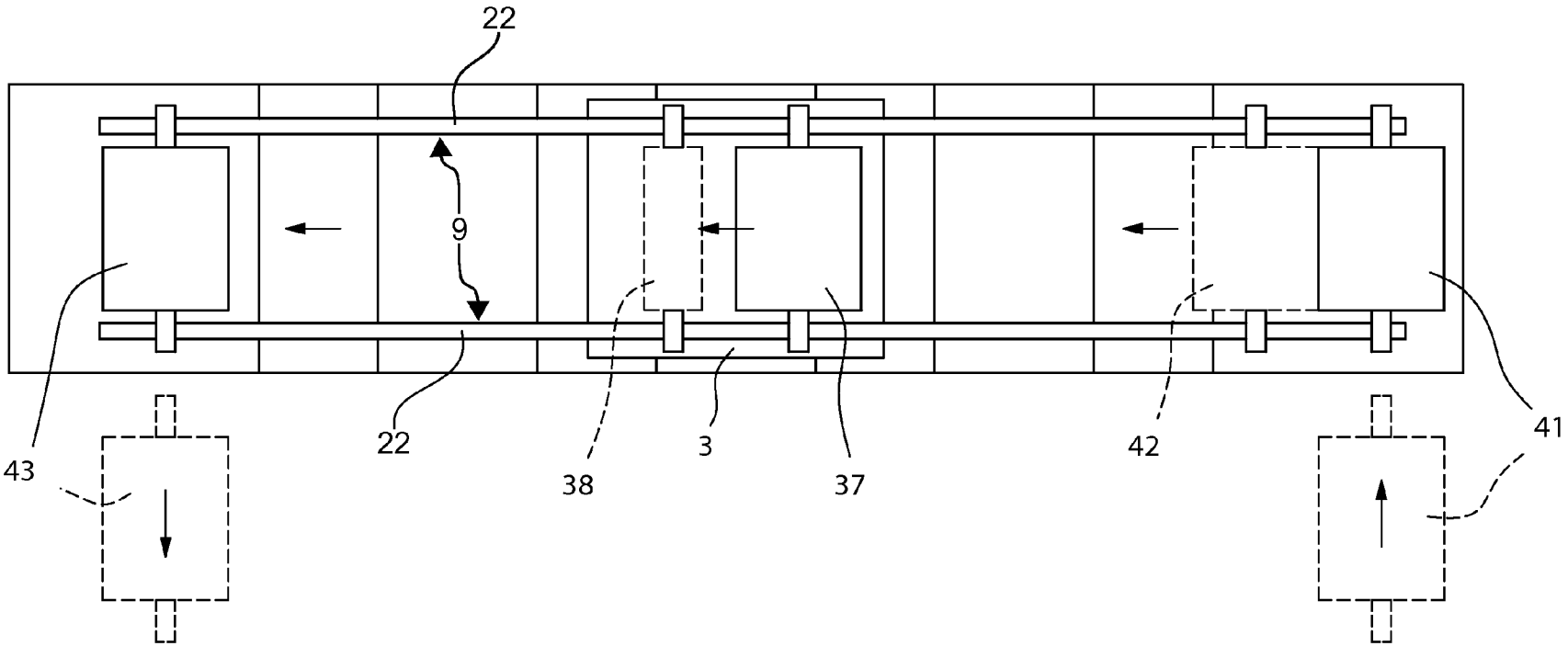
FIG. 2 is a plan view onto the system shown in FIG. 1.

FIG. 2 illustrates the operating process of the system 1. What is shown is the situation at the beginning of the printing operation. Here, the supply reel 37 is full of unused foil 4 and the collecting reel 38 is basically an empty winding core 7. "basically empty" means that the few foil layers on the winding sleeve 33 of the collecting reel are negligible; they are merely used to fix the front end of the web of foil running from the supply reel 38 via the printing unit 14 to the collecting reel 38 on the winding sleeve 33 and to secure it against coming off the latter. At the end of the printing operation, the supply reel 37 is empty and the collecting reel 38 is full of used foil 4. While the printing operation continues or when the printing press 2 is converted to the next print job (follow-up print job), the waste reel 43 is lifted off the rail system 9 by the lifting device 15 and deposited at the side of the printing press 2 as indicated by the phantom line. Then the collecting reel 38 is moved out of the transfer device 3 and along the rail system 9 into the placement area on which the old waste reel 43 lay. In this position, collecting reel 38 forms the new waste reel of the next reel-changing cycle. The next step is to push or roll the now empty winding core 7, which previously was the supply reel 37 when it was still full of foil 5, along the rail system 9 out of the unwinding device and into the rewinding device to be used as the collecting reel in the following print job. The first step in repositioning the empty winding core is to release the fixing or locking of the winding shaft 32 of the empty winding core 7 in the first winding shaft mount 35. Finally, the said winding shaft 32 is fixed or locked in the second winding shaft mount 36. In the next step, guided by the rail system 9, the replacement reel 42 full of unused foil 5 is pushed or rolled from its previous placement area on the rail system 9 and into the transfer device 3. The winding shaft 32 of the replacement reel 42 is secured in the first winding shaft mount 35 and coupled to the unwinding device to be used as the new supply reel in the following print job (follow-up print job). While the press is converted or when the follow-up job is running, the spare reel 41 full of unused foil is pushed or rolled along the rail system 9 from its placement area into the empty placement area of the previous replacement reel 42 to be used as the new replacement reel. Then the lifting device 15 places a new spare reel onto the placement area provided for this purpose on the rail system 9 as indicated by the phantom lines.

The winding cores 7 and foil reels on the rail system 9 may be displaced manually by an operator or in a fully automated way by a motorized transport system such as a chain conveyor revolving along the rail system 9. A semi-automated alternative wherein the rail system 9 is not horizontal but has a downward slope or incline in the advancing direction from the sheet feeder 10 to the sheet delivery 11 is likewise possible. In this semi-automated solution, the operator only needs to release the locking of the foil reels in their placement areas by hand or by activating an actuating drive to allow the foil reels to slide or roll along the rail system 9 driven by gravity, with an automatic locking occurring in the winding shaft mounts 35, 36.

Figure 4:
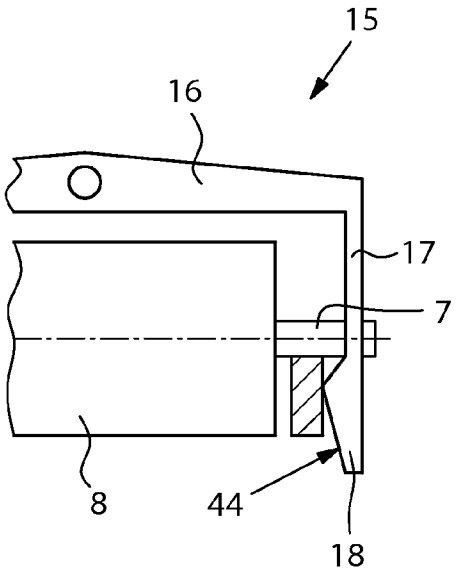
FIG. 4 is a partial view of a second variant of a lifting device associated with the system shown in FIGS. 1 and 2 and comprising a bracket with centering bevels arranged on the inside.
Figure 3:
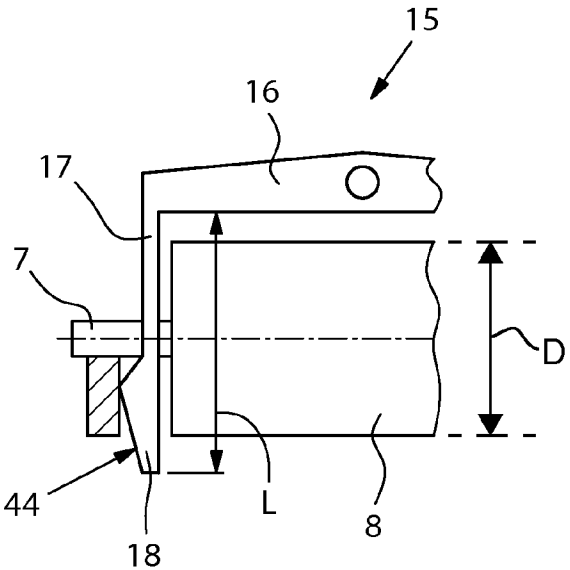
FIG. 3 is a partial view of a first variant of a lifting device associated with the system shown in FIGS. 1 and 2 and comprising a bracket with centering bevels arranged on the outside.

FIGS. 3 to 4 illustrate a foil reel 8, which may be the spare reel 41 or the waste reel 43. The lifting device 15 has a receiving element 16 for receiving the foil reel 8. The receiving element 16 is designed as a bracket and has two fork arms 17 that engage with the winding core 7 when the foil reel 8 is being carried. The winding sleeve 33 and the foil coil located thereon are situated between the fork arms 17. In FIGS. 3 to 4 (and in FIGS. 6 and 7), the winding core 7 is illustrated in a simplified way, ignoring the fact that the winding core 7 consists of the winding sleeve 33 and the winding shaft 32 that is engaged by the fork arms 17 during a lifting operation. The foil coil may consist of more or fewer layers of foil 5 and the foil 5 may be thicker or thinner. There is, however, a maximum outer diameter D for the foil coil and the foil reel 8, i.e. the possible number of layers is limited. The maximum outer diameter D is defined by technical conditions such as constructional aspects or safety aspects and may not be exceeded in the rewinding process. The arm length L of the fork arms 17 is greater than the maximum outer diameter D, causing the fork arms 17 to protrude in a downward direction beyond the circumferential line of the foil reel 8 as defined by the maximum outer diameter D. This provides lateral protection of the foil reel 8 against damage due to collision between the foil reel 8 and the rail system 9 when the foil reel 8 is lowered.

Figure 7:
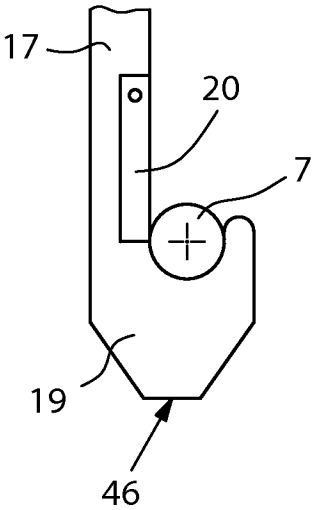
FIG. 7 is a detail view of the crane hook of FIG. 6 with the ratchet pawl in a release position.
Figure 6:
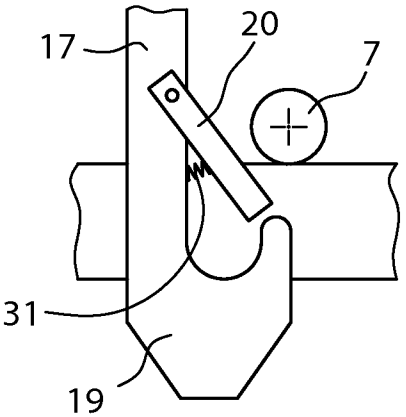
FIG. 6 is a detail view of a crane hook associated with one of the lifting devices shown in FIGS. 3 to 5 and comprising a ratchet pawl in a locked position.

On each end, the receiving element 16 has a centering device 18 and a crane hook 19 (cf. FIGS. 6 and 7). The centering devices 18 comprise centering bevels 44 and are arranged on the lower ends of the fork arms 17. The centering devices 18 are provided to center the foil reel 8 relative to the rail system 9 as the foil reel 8 is being lowered and to ensure that the foil reel is lowered between the two guide rails 22 without colliding with the latter to avoid potential damage to the foil. In case of an axial offset (off-center position) of the foil reel 8 relative to the guide rails 22, one of the centering bevels 44 will hit one of the guide rails 22. Depending on the direction of the offset, it may be the centering bevel 44 on the operator side of the printing press 2 that hits the operator-side guide rail 22 or it may otherwise be the drive side centering bevel 44 that hits the guide rail 22 on the drive side of the printing press 1. As the receiving element 16 continues to be lowered, this contact causes the receiving element 16 and the foil reel 8 held therein to be urged axially away from the guide rail 22 that the foil reel 8 would otherwise hit.

In the variant shown in FIG. 3, the two centering bevels 44 face each other and they converge in a downward direction.

In the variant shown in FIG. 4, the two centering bevels 44 face away from each other and they diverge in a downward direction.

Figure 5:
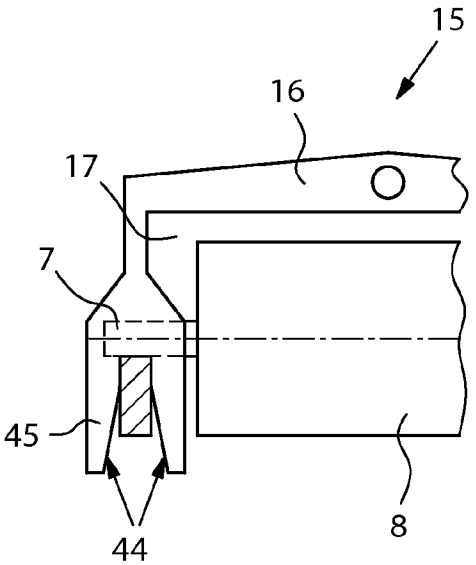
FIG. 5 is a partial view of a third variant of the lifting device associated with the system shown in FIGS. 1 and 2 and comprising a bracket with centering forks.

In the variant shown in FIG. 5, four centering bevels 44 are provided and are arranged in pairs on two centering forks 45, each of which is arranged on a different one of the two fork arms 17 of the bracket. Each centering fork 45 has two centering bevels 44 that face one another and diverge in a downward direction.

FIGS. 6 and 7 illustrate the design of the aforementioned crane hooks 19 that form the lower ends of the fork arms 17. The respective crane hook 19 has a hook aperture whose inner dimension (hook aperture width) is adapted to the outer dimension or diameter of the winding core 7 or winding shaft 32 to be received. The hook aperture of the crane hook 19 is U-shaped. Outside the U, a pivotable closing element 20 is supported in the crane hook 19. A spring 31 presses the closing element 20 into a locking or closing position (cf. FIG. 6) in which the closing element 20 closes the hook aperture and is pointed to the tip of the hook. Basically, the closing element 20 is spring-loaded in the same way as a safety catch of a conventional crane hook of the prior art; the only difference between the closing element 20 and the safety catch is in its function and in the resultant dimensioning and arrangement: a safety catch's task is to prevent objects held by the crane hook from unintentionally sliding out of the crane hook or its hook aperture. Therefore, the safety catch is in the closed position when the object is located in the crane hook. In contrast, the task of the closing element 20 is to prevent the object—here, the winding core 7—from sliding into the hook aperture when the crane hook is to remain empty. FIG. 7 shows that the closing element 20 cannot be switched to the closed position while the winding core 7 is in the hook aperture. The closing element 20 is dimensioned and arranged in such a way that when the winding core 7 is in the hook aperture, the closing element 20 is pushed away from the tip of the hook against the reset force of the spring 31 and is held in a release position (cf. FIG. 7) of the closing element 20 in which the hook aperture, which is directed upward, is not closed. In the release position, the closing element 20 snugly fits against that one of the two legs of the hook aperture that does not have the tip of the hook. On its lower side, the crane hook 19 may have a flattened portion 46 to stand on.

Figure 8:
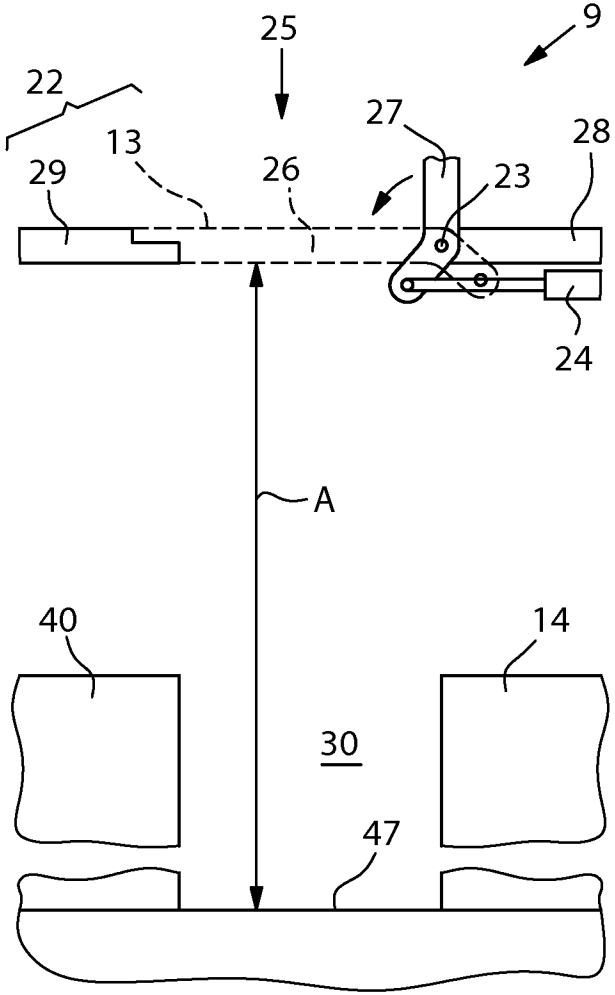
FIG. 8 illustrates an adjustable intermediate rail section of the guide rail system shown in FIGS. 1 and 2.

FIG. 8 illustrates two neighboring printing units, which are printing units 14, 40 (cf. FIG. 1) but they may also be the printing units 14, 39. A passage 30 for an operator is provided between the neighboring printing units. Above the two printing units, the rail system 9 traverses the passage 30. There is a vertical distance A of 2 meters, for example, between the rail system 9 and a tread (foot support surface) 47 in the region of the passage 30. A person entering or passing through the passage 30 may get hurt on the rail system 9. To avoid this danger, at least one of the two guide rails 22 above the passage 30 is divisible. The said guide rail 22 is divided into a first rail section 28 above the one printing unit 14, a second rail section 29 above the other printing unit 40, and a third rail section 13 directly above the passage 30. The third rail section 13 is an intermediate portion separate from the two other rail sections 28, 29 and connected to the first rail section 28 by a joint 23. The third rail section 13 may be pivoted about the joint 23 into a first position 26 and into a second position 27 either by hand or by an actuating drive 24 such as a pneumatic cylinder as shown. In the first position 26, which is indicated by the dashed phantom line, the third rail section 13 is aligned to be flush with the two adjacent rail sections 28, 29, in the present example horizontal, and connects the two rail sections 28, 29 to form a continuous guide rail 22 made up of the three rail sections 13, 28, 29 together. In the first position 26, the free end of the third rail section 13, i.e. the end opposite the joint 23, may rest on the free end of the second rail section 29. For this purpose, the two free ends may have complementary angled portions engaged with each other or, as shown, steps that are engaged with each other. In the second position 27, which is indicated by a continuous line, the third rail section 13 is folded up into a vertical position, creating a gap 25 approximately as wide as the passage 30 between the two outer rail sections 28, 29.

The invention claimed is:

1. A printing system, comprising:

a printing press having a sheet feeder and a sheet delivery;

a transfer device configured for transferring foil to printing material; and a storage section for temporarily storing winding cores and foil reels with foil to be transferred to the printing material, said storage section being formed with a rail system having two rails formed with or without a rail joint extending through and beyond said transfer device, said two rails projecting beyond said transfer device in a direction towards said sheet feeder and in a direction towards said sheet delivery.

2. The system according to claim 1, wherein said rail system extends beyond said transfer device in a direction upstream and/or in a direction downstream of said transfer device in a process flow direction.

3. The system according to claim 2, wherein said rail system extends up to one or both of said sheet feeder upstream of said transfer device or up to said sheet delivery downstream of said transfer device.

4. The system according to claim 1, wherein said rail system includes placement areas for the winding cores and for the foil reels.

5. The system according to claim 1, wherein said rail system includes at least one adjustable rail section.

6. The system according to claim 5, wherein said adjustable rail section is located between printing units of said printing press.

7. The system according to claim 1, which further comprises a lifting device for lifting the winding cores and the foil reels.

8. The system according to claim 7, wherein said lifting device includes a receiving element for receiving a respective winding core or a respective foil reel and wherein said receiving element has two fork arms, each with a length that is greater than an outer diameter of a foil reel that is filled to the maximum.

9. The system according to claim 7, wherein said lifting device includes centering devices for centering the winding cores and the foil reels relative to said rail system.

10. The system according to claim 7, wherein said lifting device includes crane hooks with closing elements for closing said crane hooks.

* * * * *